United States Patent [19]

Ekemar et al.

[11] Patent Number: 4,772,339

[45] Date of Patent: Sep. 20, 1988

[54] METHOD OF TREATING CEMENTED CARBIDE BODIES REGARDING THEIR COMPOSITIONS AND STRUCTURES

[75] Inventors: Carl S. G. Ekemar, Saltsjö-boo; Ulf E. Jutterström, Stockholm; Per I. Andersson, Saltsjö-Boo, all of Sweden

[73] Assignee: Santrade Limited, Luzern, Switzerland

[21] Appl. No.: 10,800

[22] Filed: Feb. 4, 1987

[30] Foreign Application Priority Data

Feb. 5, 1986 [SE] Sweden ..... 8600503

[51] Int. Cl.[4] ..... C21D 1/00

[52] U.S. Cl. ..... 148/126.1; 148/127; 51/307

[58] Field of Search ..... 148/126.1, 127; 51/307

[56] References Cited

U.S. PATENT DOCUMENTS

| | | | |
|---|---|---|---|
| Re. 32,111 | 4/1986 | Lambert et al. | 428/698 |
| 4,119,459 | 10/1978 | Ekeman et al. | 428/564 |
| 4,230,462 | 10/1980 | Moskowitz | 51/307 |
| 4,357,382 | 11/1982 | Lambert et al. | 428/698 |
| 4,466,945 | 8/1984 | Cheney et al. | 423/53 |
| 4,470,956 | 9/1984 | Cheney et al. | 423/53 |

*Primary Examiner*—Stephen J. Lechert, Jr.

*Attorney, Agent, or Firm*—Burns, Doane, Swecker & Mathis

[57] ABSTRACT

The present invention relates to a unique and advantageous method making possible a superior technical and economical separation of cemented carbide bodies based upon their compositions and structures.

The critical point of the method is, that after formation of a melt by melting of the binder metal including dissolved elements from the hard constituents there are so strong driving forces dependent on the grain size variables, proportions and compositions of the hard constituent phases, that melt is re-distributed between cemented carbide bodies in communicating contact. The re-distribution is determined by differences of mean grain sizes, grain size distributions, relative proportions and compositions of the hard constituent phases of the bodies.

13 Claims, No Drawings

METHOD OF TREATING CEMENTED CARBIDE BODIES REGARDING THEIR COMPOSITIONS AND STRUCTURES

The cemented carbides (hard metals) are tool and wear part materials for demanding application conditions.

The present invention relates to a unique and advantageous way to obtain a superior technical and economical separation of cemented carbide bodies on the basis of their compositions and structures.

The elements which are the main alloying elements and the most used elements in cemented carbides are present in the earth's crust in only small percentages. The most representative metallic elements are tungsten, tantalum, niobium(columbium), cobalt and the more generally occurring element titanium. Also molybdenum, chromium, vanadium, nickel and iron are common metallic alloying elements in cemented carbide. The preparation of raw materials, possible to weigh in, for cemented carbide production in the form of powders of pure metals, metal alloys, carbides, nitrides etc demands advanced processes in many steps and with high precision.

Ore based raw materials ready for weighing in for cemented carbide production are expensive.

Collecting cemented carbide scrap and reprocessing this scrap to raw materials possible to weigh in for cemented carbide production is common today.

Processes for the chemical dissolution of cemented carbide scrap including complete or partial separation of the metallic elements have been used. The end products are powders of metals, metal alloys, carbides, nitrides etc possible to weigh in for cemented carbide production. Some of the chemical processes are very disadvantageous for the surrounding environment and demand rigorous protecting measures such as removal of nitrous gases. Chemical reprocessing methods are economically acceptable only if cemented carbide scrap can be acquired at costs which are generally much lower than the world-market prices of normal cemented carbide scrap. Heavily contaminated cemented carbide scrap have such low prices and are thus suitable for chemical reprocessing.

The main part of the cemented carbide scrap, which goes to re-use, is reprocessed by more direct processes than the chemical ones, namely by, for example, the "Cold stream process" or the "Zinc process". The "Cold stream process" means mechanical disintegration of cemented carbide scrap to powder consisting of hard constituents and binder metals. The "Zinc process" is characterized by a transformation of cemented carbide scrap to powder by metallurgical means. The process is performed at temperatures generally not exceeding 1000° C. Zinc is diffused into the cemented carbide to alloy itself with the binder metal, usually cobalt. In this manner, the cemented carbide disintegrates into powder. Zinc is then removed in vacuum by evaporation in a furnace at high temperature in combination with precipitation in a condenser.

Thermal treatment of cemented carbide scrap in batches of conglomerated pieces at temperatures around 2000° C. for generating of lumps of porous, industrially treatable but not separable, sintered together material is known.

The mentioned methods as well as other known methods of mechanical or metallurgical decomposition of cemented carbide scrap are characterized by the lack of the possibility of separating the components into parts of cemented carbide. It has therefore been attempted before the decomposition to divide cemented carbide scrap into composition and/or structure groups by manual separation and/or by separation with methods based upon physical, chemical and/or mechanical properties of the cemented carbides.

When it relates to heavy cemented carbide bodies for such applications as high pressure synthesis, hot rolling, cold rolling, tube drawing, etc., the mentioned manual technique of separation works together with the measurement of, for example, density. A contributory reason for this is that the actual grades as well as the grades in cemented carbide bodies for rock drilling and rock cutting tools have tungsten carbide as the dominating hard constituent.

There have been attempts to find solutions for the automatic separation of small cemented carbide bodies to provide compositions and/or structures for the preparation of cheap raw materials with suitable compositions.

Separate or combined methods tested have been based upon the technique of letting bodies currently pass stations for automatic measurement of chemical, physical and/or mechanical data of each separate passing body. The measuring signals have been transmitted to units which collect and treat the signals to control separating devices which divide the bodies into measuring data classes. Chemical data have been produced by means of, for example, methods based upon optical emission spectroscopy, X-ray fluorescence analysis, analysis of back-scattering of rays from radioactive sources and/or chemical analysis by means of colorimetry. Physical data produced on parts, such as density, electrical conductivity, coercivity and saturation magnetization have also been used as basis for separation. Among mechanical data, hardness has been used as a basis for separation.

Separation of cemented carbide scrap in classes by industrial machineries based upon magnetic and gravimetric methods has been tested and is possible to use.

U.S. Pat. No. 4,466,945 and U.S. Pat. No. 4,470,956 are related to the utilisation of the measurement of coercivity for the separation of cemented carbide bodies having almost the same binder metal contents. Chemical composition in the two patents is proposed to be established by X-ray fluorescence determinations or by optical emission spectroscopy determinations. The production of powders is tied to the zinc process—U.S. Pat. No. 4,466,945—or to chemical dissolution of binder metal with hydrochloric acid—U.S. Pat. No. 4,470,956.

The grades which are found in small scrap cemented carbide bodies with weights around 100–150 g and lower include the most common grades in compositions and structures. The main part of small scrap cemented carbide bodies have been used for chipforming machining of metals and other materials. The largest and most important group is the indexable cutting inserts, whose mean weight is about 10 g.

Within the field of chipforming machining the grades have not, unlike other fields of application, been standardized. Different cemented carbide producers develop, design and manufacture their grades, cutting inserts and tools based upon experiences, estimations and ideas. Cemented carbide grades for chipforming machining are characterized by an abundance of compositions and structures. A rough, very overlapping relation exists, as the table below shows, between fields of application, on one hand, and material data, on the other hand, particularly compositions and structures. The hardness and composition values of the table can—weighed against each other—be considered as an indication of the mean grain sizes of the hard constituent phases.

| Field of application | | Compositions % by weight | | Hardness Vickers units |
|---|---|---|---|---|
| ISO | WC | (TiTaNb)C | Co | HV |
| P10 | 55–70 | 20–35 | 7–10 | 1500–1750 |
| P20 | 65–80 | 12–25 | 7.5–10.5 | 1450–1650 |
| P30 | 70–82 | 7.5–20 | 8–11 | 1400–1600 |
| P40 | 74–86 | 5–15 | 8.5–13 | 1300–1500 |
| M10 | 83–88 | 7–10 | 5–7 | 1450–1700 |
| M20 | 81–86 | 8–11 | 6–8 | 1350–1600 |
| K05 | 92–97 | 0–3 | 3–5 | 1700–1950 |
| K10 | 89–95 | 0–4 | 5–7 | 1600–1850 |
| K20 | 88–94 | 0–4 | 6–8 | 1400–1650 |

The overlaps have become even more complex after since the advent of coated cutting inserts. Such cutting inserts amount to about the half of all the cutting inserts being produced. The layers have a thickness of 5–10 μm and consist for example of titanium carbide, titanium nitride, titanium carbonitride, hafnium carbide, hafnium nitride and/or aluminium oxide.

The abundant supply of coated cutting inserts have caused the mentioned separation methods based upon determination of contents of chemical constituents to be unsuccessful.

From the table, it is evident that separation methods based upon properties which follow the binder metal contents can only be used for a very rough division.

The density of cemented carbide grades for chip-forming machining is essentially within the range of 10–15 g/cm$^3$. Important constituents of cemented carbide have the following densities:

| | |
|---|---|
| Tungsten carbide | 15.7 g/cm$^3$ |
| Tantalum carbide | 14.5 g/cm$^3$ |
| Cobalt | 8.9 g/cm$^3$ |
| Niobium carbide | 7.8 g/cm$^3$ |
| Titanium carbide | 4.9 g/cm$^3$ |

Cemented carbide grades show considerable overlappings with respect to densities. Gravimetric methods therefore make only a rough separation possible.

A technically economically realistic, industrial separation of scrap cemented carbide bodies requires high capacity. High capacity means, however, a reduction of the separation accuracy. Requirements on capacity and separation accuracy in a situation where the material data of the various grades are characterized by complex overlap have resulted in the lack of a significant, more or less mechanized and automatized separation of cemented carbide bodies based upon material data of various grades.

The method of the present invention shows, however, quite surprisingly that the contents of binder metal can be redistributed between cemented carbide bodies so that a superior, rational separation of compositions by means of methods above can be technically economically possible and attractive.

If cemented carbide is heated to the temperatures of incipient melting, a melt is formed of the binder phase forming elements—principally cobalt, nickel and/or iron,—and of elements dissolved from the hard constituent phases. Cemented carbide bodies coated with layers of, for example, titanium carbide, titanium nitride, titanium carbonitride, hafnium carbide, hafnium nitride and/or aluminium oxide get their layers attacked and broken down by the melt. Bridges are formed between bodies being in contact with each other. The cemented carbide bodies form systems of vessels having molten binder metal with dissolved elements as a communicating liquid.

Cemented carbide grades are characterized by the fact that besides the binder metal phase, where cobalt, nickel and/or iron are the dominating elements, they contain one or more hard constituent phases, as a rule one or two, namely hexagonal hard constituent phase, tungsten carbide, and/or cubic hard constituent phase consisting of, for example, titanium carbide, tantalum carbide, niobium carbide and/or vanadium carbide etc. with tungsten carbide in solid solution. The chemical composition—described by contents and compositions of phases—as well as the mean grain sizes and the grain size distributions, determine the properties by which the cemented carbide grades are characterized. When cemented carbide is heated according to the present invention, it is found that the mean grain sizes, grain size distributions, proportions and compositions of the hard constituent phases have a directing influence upon the melts, communicating with each other in the cemented carbide bodies. Bodies in communicating contact with each other have thus a uniting community of melt. The effect of the surprisingly strong driving forces is that bodies with coarse-grained hard constituent grains will accommodate themselves to a lower content of melt than bodies having more fine-grained hard constituents. In grades where, for example, titanium carbide, tantalum carbide, niobium carbide, vanadium carbide, hafnium carbide, titanium nitride and related hard constituents are present wholly or partly instead of tungsten carbide, the capacity of holding the melt is reduced when bodies of said grades occur together with bodies of grades having higher contents of tungsten carbide. The average content of binder phase forming metals, principally cobalt, nickel and/or iron, in a system of bodies in contact with each other will regulate together with the mentioned hard constituent factors the contents of melt in the bodies, respectively.

Hard constituents in the form of, for example, the earlier mentioned carbides or nitrides in contact with one or more elements of the iron-group metals as the main element can be made to grow in grain size by increasing the temperature level above the temperature of incipient melting and prolonging the time at said temperature level. By well-balanced cycles of temperature and time, a strengthened instrument for redistribution of melt is attained. It has been found that treatments of bodies in communicating contact with each other according to the invention have to be performed at temperatures within the temperature interval 1250° C.–2500° C., preferably 1350° C.–2350° C. and particularly 1400° C.–2200° C. The time at the treatment temperature, i.e. the highest temperature, has to be within a time interval not exceeding 10 hours, preferably not exceeding 8 hours and particularly not above 5 hours. Cemented carbide bodies being furnace treated in order to give the intended redistribution must have representative amounts of the bodies making a suitable batch, completely or partly in communicating contact. At least 75% by weight, preferably least 85% by weight and particularly least 95% by weight of the bodies in a batch have to be in communicating contact with each other. At increasing temperature, the content of formed melt as well as the vapour pressures of the elements in the melt increase. At increasing temperature, the liquid phase is redistributed to an increasing extent via the gas phase. Direct contact between the bodies is not necessary for communicating contact in treatments at temperatures within the upper range of the temperature interval. It is essential that the redistribution of melt between the cemented carbide bodies becomes as complete as possible. Therefore, more than 75% by weight, preferably more than 80% by weight and particularly more than 85% by weight of the bodies being treated according to the invention, have to weigh less than 150 g, preferably less than 125 g and particularly less than 100 g.

A communicating contact is synonymous with a redistribution of melt taking place with a minimized formation of bonds between bodies. Bodies in a batch being subjected to furnace treatment according to the invention and then cooled to room temperature can, however, be more or less strongly metallurgically bonded to each other. The melt has of course, solidified. It has, been found that in order to make an acceptable separation into composition and structure classes possible at least 65% by weight, preferably at least 75% by weight and particularly at least 85% by weight of the amount treated according to the invention has to comprise bodies which after mechanical separation treatment contain at the most 10% by weight, preferably at the most 7.5% by weight and particularly at the most 5% by weight of metallurgically bonded material of different kind.

The following examples describe results from treatments of cemented carbide bodies according to the invention.

EXAMPLE 1

In the production of cemented carbide buttons for rock drill bits, the buttons of a grade 1 from lot A happened to be mixed with buttons of a grade 2 from a lot B. The buttons of the two different lots were identical regarding design and size. The amount of buttons from lot A was twice as large as the amount of buttons from lot B. The data of the grades of the sintered buttons were:

| Grade | Composition, % by weight WC | Co | Density g/cm³ | Hardness HV |
|---|---|---|---|---|
| 1 | 94 | 6 | 14.9 | 1400–1450 |
| 2 | 94 | 6 | 14.9 | 1525–1575 |

The table shows (indirectly) that the grades being equal in chemical composition had different carbide grain sizes.

The buttons were placed on graphite trays by means of vibration feeders in single layers at random orientation in relation to each other and having a direct metallic contact. Each tray contained about 10 kg of buttons having a weight of 20 g per button. A furnace was loaded with totally 450 kg of material. The batch was heated to 1425° C. and maintained for one hour at said temperature. The furnace atmosphere consisted of hydrogen. After cooling of the batch the furnace was emptied. The bodies were separated from each other by a pneumatic percussion machine. It was established that 90% by weight of the bodies had less than 4% by weight of metallurgically bonded material from a different grade.

The bodies being separated from each other then passed an automatically working machinery provided with a weighing equipment for weighing without and within a magnetic field, counteracting the force of gravity, and having a sorting equipment controlled by a microprocessor based on weighing data. By a calibration with standard bodies the plant was brought to divide the batch into two lots. The amounts of the two lots were to each other as 2 to 1. The bigger lot has been indicated with C and the smaller one with D. Samples were taken for chemical analysis, density determination, hardness measurement and structure examination. The following results were obtained:

| Lot | Composition, % by weight WC | Co | Density g/cm³ | Hardness HV |
|---|---|---|---|---|
| C | 94.9 | 5.1 | 15.0 | 1475–1500 |
| D | 92.3 | 7.7 | 14.7 | 1500–1525 |

Metallurgical examinations showed that the bodies of lot C had the same carbide grain size as the bodies of lot A. Likewise, the bodies of the lots D and B showed structural agreement. A furnace treatment according to the invention had made a rational separation of the buttons of lot A from the buttons of lot B possible. The two treated lots produced by furnace treatment and separation were re-processed to cemented carbide powder by means of the zinc process.

EXAMPLE 2

Two lots of cutting inserts SPUN 120308 had through mistakes in connection with the stocking of unmarked inserts been mixed to from one lot. One of the lots, lot A, contained 3 times as many cutting inserts as the other lot, lot B. The inserts of the two lots were coated with layers of titanium carbide. The cemented carbide grades, which represented the material of the substrates of the cutting inserts for the two lots, were not the same. The following applies to the two grades:

| Lot | Composition, % by weight WC | (TiTaNb)C | Co | Hardness HV |
|---|---|---|---|---|
| A | 85.9 | 8.6 | 5.5 | 1550 |
| B | 92.3 | 1.7 | 6.0 | 1500 |

The cutting inserts were placed on graphite trays by means of vibration feeders in single layers at random orientation in relation to each other and having direct metallic contact with each other. A furnace was loaded with 300 kg total of cutting inserts. The batch was heated to 1500° C. and maintained for two hours at said temperature, after which the batch cooled to room temperature. It was established that 95% by weight of the cutting inserts had less than 3% by weight of metallurgically bonded material from a different grade. Samples were taken out for metallographical examination and chemical analysis. The metallographic examination showed that the titanium carbide layers had been dissolved during the furnace treatment. Furthermore, the chemical analysis showed that the cutting inserts of lot A, i.e. those inserts having the higher content of the cubic hard constituent phase—(TiTaNb)C with dissolved WC—had their cobalt content decreased to 5.1% by weight, while the cutting inserts of lot B had got the cobalt content increased to 7.1% by weight.

The separated cutting inserts from each other were fed through automatic working machinery consisting of equipment for measuring of the cobalt content of the cutting inserts by emission spectroscopy connected with a sorting equipment controlled by a microprocessor based on the analysis data. The effectiveness of the sorting equipment in function was calibrated by standard bodies. The time for the emission of radiation from the arc could be held as low as 2 seconds per cutting insert. The amount of cutting inserts originating from lot A was three times larger than the amount of cutting inserts of lot B. Final transformation to powder was performed by the zinc process.

We claim:

1. Method of re-distribution of binder metal between a mixture of cemented carbide bodies separable into two or more cemented carbide grades different from each other by the proportions, compositions, mean grain sizes and/or grain size distributions of hard constituent phases, characterized in that the bodies are heated to a temperature within the range of 1250° C. to 2500° C. and that at least a representative amount of the bodies are entirely or partly in communicating contact with each other.

2. Method according to the claim 1, characterized in that the time at the highest temperature within the said range does not exceed 10 hours.

3. Method according to claim 1, characterized in that the communicating contact is a flow of melt between the bodies and/or as a consequence of vaporization and condensation, a flow of the elements of the melt between the bodies via a gaseous phase.

4. Method according to claim 1, characterized in that the bodies after said heat treatment are separated from each other and after separation consist of at least 65% by weight of bodies having at the most 10% by weight of metallurgically bonded material of different kind.

5. Method according to claim 1, characterized in that at least 75% by weight of the bodies in a batch are in communicating contact.

6. Method according to claim 1, characterized in that more than 75% by weight of bodies being treated, weigh less than 150 g.

7. Method according to claim 1 wherein the bodies are heated to a temperature within the range of from 1350° C. to 2350° C.

8. Method according to claim 1 wherein the time at the highest temperature within the range does not exceed 8 hours.

9. Method according to claim 4 wherein the bodies after said separation consist of at least 75% by weight of bodies having at most 7.5% by weight of metallurgically bonded material of different kind.

10. Method according to claim 1 wherein at least 85% by weight of the bodies are in communicating contact with each other.

11. Method according to claim 1 wherein more than 80% by weight of said bodies being treated weigh less than 125 g.

12. A method of re-distribution of binder metal between a mixture of cemented carbide bodies separable into two or more cemented carbide grades different from each other by the proportions, compositions, mean grain sizes and/or grain size distributions of hard constituent phases, comprising:

mixing bodies of two or more cemented carbide grains which differ in composition of grain size from each other;

heating the mixture to a temperature in the range of 1250° C. to 2500° C. for a time of up to 10 hours while at least 75% by weight of the said bodies are in communicating contact such that at least 65% by weight of the bodies after separation have a maximum of 10% by weight of metallurgically bonded materials of a different kind;

cooling the heated mixture; and separating the said bodies.

13. A method of re-distribution of binder metal between a mixture of cemented carbide bodies separable into two or more cemented carbide grades different from each other by the proportions, compositions, mean grain sizes and/or grain size distributions of hard constituent phases, comprising:

mixing bodies of two or more cemented carbide grains which differ in composition of grain size from each other;

heating the mixture to a temperature in the range of 1350° C. to 2350° C. for a time of up to 8 hours while at least 85% by weight of the said bodies are in communicating contact such that at least 75% by weight of the bodies after separation have a maximum of 7.5% by weight of metallurgically bonded materials of a different kind;

cooling the heated mixture; and separating the said bodies.

* * * * *

UNITED STATES PATENT AND TRADEMARK OFFICE

CERTIFICATE OF CORRECTION

PATENT NO. : 4,772,339

DATED : September 20, 1988

INVENTOR(S) : Ekemar et al.

It is certified that error appears in the above-identified patent and that said Letters Patent is hereby corrected as shown below:

Title Page, Column 1, under U.S. Patent Documents, "Ekeman et al." should read -- Ekemar et al. --.

Column 6, line 38, "from" should read -- form --.

Column 8, line 24, "grains" should read -- grades --; and
line 42, "grains" should read -- grades --.

Signed and Sealed this

Twenty-seventh Day of June, 1989

*Attest:*

DONALD J. QUIGG

*Attesting Officer*

*Commissioner of Patents and Trademarks*